US008992184B2

(12) United States Patent
Wagner

(10) Patent No.: US 8,992,184 B2
(45) Date of Patent: Mar. 31, 2015

(54) LUBRICANT PUMP SYSTEM

(75) Inventor: René Wagner, Schleusingen (DE)

(73) Assignee: Mahle International GmbH (DE)

( * ) Notice: Subject to any disclaimer, the term of this patent is extended or adjusted under 35 U.S.C. 154(b) by 416 days.

(21) Appl. No.: 13/377,463

(22) PCT Filed: Jun. 4, 2010

(86) PCT No.: PCT/EP2010/057836

§ 371 (c)(1),
(2), (4) Date: Feb. 20, 2012

(87) PCT Pub. No.: WO2010/142611

PCT Pub. Date: Dec. 16, 2010

(65) Prior Publication Data

US 2012/0148423 A1 Jun. 14, 2012

(30) Foreign Application Priority Data

Jun. 12, 2009 (DE) ..... 10 2009 024 698
Oct. 5, 2009 (DE) ..... 10 2009 048 320

(51) Int. Cl.
*F04B 49/00* (2006.01)
*F04B 1/06* (2006.01)
(Continued)

(52) U.S. Cl.
CPC ..... *F04C 14/226* (2013.01); *F01M 1/16* (2013.01); *F04C 2/332* (2013.01); *F04C 14/223* (2013.01); *F04C 2270/18* (2013.01); *F04C 2270/70* (2013.01)
USPC ..... 417/220; 417/219; 418/26; 418/27; 418/30

(58) Field of Classification Search
CPC ..... F04C 2/332; F04C 14/223; F04C 14/226; F01M 1/16
USPC ..... 417/220, 221, 218, 219, 310, 311; 418/26, 30, 24, 27, 29
See application file for complete search history.

(56) References Cited

U.S. PATENT DOCUMENTS 4,437,819 A 3/1984 Merz
4,600,364 A * 7/1986 Nakatani et al. ..... 417/216
(Continued)

FOREIGN PATENT DOCUMENTS

CN 2436689 Y 6/2001
DE 4231690 A1 3/1994
(Continued)

OTHER PUBLICATIONS

English abstract provided for DE-4231690.
(Continued)

*Primary Examiner* — Charles Freay
*Assistant Examiner* — Lilya Pekarskaya
(74) *Attorney, Agent, or Firm* — Rader, Fishman & Grauer PLLC

(57) ABSTRACT

A lubricant pump system may include a lubricant pump controlled by a proportional valve. An actuating unit may be disposed in the lubricant pump and configured to control a delivery output of the lubricant pump. A first pressure chamber and at least one second pressure chamber may be configured to adjust the actuating unit against a spring, wherein the second pressure chamber is smaller than the first pressure chamber. In response to a failure of the proportional valve, the lubricant pump may be exclusively pressurized via the at least one second pressure chamber.

9 Claims, 2 Drawing Sheets

(51) Int. Cl.

| | |
|---|---|
| ***F01C 20/18*** | (2006.01) |
| ***F03C 2/00*** | (2006.01) |
| ***F03C 4/00*** | (2006.01) |
| ***F04C 2/00*** | (2006.01) |
| ***F04C 14/18*** | (2006.01) |
| ***F04C 28/18*** | (2006.01) |
| ***F04C 14/22*** | (2006.01) |
| ***F01M 1/16*** | (2006.01) |
| ***F04C 2/332*** | (2006.01) |

(56) References Cited

U.S. PATENT DOCUMENTS

| | | | | |
|---|---|---|---|---|
| 4,679,995 | A | 7/1987 | Bristow | |
| 6,120,256 | A | 9/2000 | Miyazawa | |
| 6,244,830 | B1 | 6/2001 | Agner | |
| 6,578,555 | B2 * | 6/2003 | Sykes | 123/479 |
| 8,057,201 | B2 * | 11/2011 | Shulver et al. | 418/26 |
| 2001/0025620 | A1 * | 10/2001 | Ogawa et al. | 123/295 |
| 2007/0224067 | A1 * | 9/2007 | Arnold et al. | 418/26 |
| 2008/0187446 | A1 | 8/2008 | Staley et al. | |
| 2008/0247894 | A1 | 10/2008 | Lutoslawski et al. | |
| 2009/0047147 | A1 | 2/2009 | Yamamuro | |
| 2009/0196780 | A1 | 8/2009 | Shulver et al. | |
| 2010/0086423 | A1 * | 4/2010 | Armenio et al. | 418/27 |
| 2010/0226799 | A1 * | 9/2010 | Watanabe et al. | 417/364 |

FOREIGN PATENT DOCUMENTS

| | | | |
|---|---|---|---|
| DE | 102005050216 | A1 | 4/2007 |
| DE | 102006061326 | A1 | 7/2008 |
| DE | 102008037665 | A1 | 2/2009 |
| DE | 112007001037 | T5 | 4/2009 |
| EP | 0851123 | A2 | 7/1998 |
| JP | 53-130505 | | 11/1978 |
| JP | 2009-036137 | A | 2/2009 |
| JP | 2009-047041 | A | 3/2009 |
| WO | WO-2005108792 | A1 | 11/2005 |
| WO | WO-2007128105 | A1 | 11/2007 |
| WO | WO-2008030491 | A2 | 3/2008 |
| WO | WO-2008037070 | A1 | 4/2008 |

OTHER PUBLICATIONS

English abstract for DE-102005050216.
English abstract for DE-102006061326.
English abstract for CN-2436689.
English abstract for JP-200936137.
JP Office Action 2012-514429, dated Jan. 21, 2014.

* cited by examiner

LUBRICANT PUMP SYSTEM

CROSS-REFERENCES TO RELATED APPLICATION

This application claims priority to German Patent Applications 10 2009 024 698.3 filed on Jun. 12, 2009 and 10 2009 048 320.9 filed Oct. 5, 2009 and PCT/EP2010/058427 filed on Jun. 4, 2010, which are hereby incorporated by reference in their entireties.

TECHNICAL FIELD

The present invention relates to a characteristic-map-controlled lubricant pump system with a lubricant pump for supplying a combustion engine with lubricant. The invention also relates to a lubricant pump for such a characteristic-map-controlled lubricant pump system.

BACKGROUND

The use of flow-controlled lubricant pumps in combustion engines in order to be able to bring for example a delivery rate and a pressure up close to the respective requirements of the combustion engine is the state of the art. In most cases, this is performed by way of the loading of an actuating unit within the lubricant pump, such as for example a control piston or an adjusting ring, with an oil pressure originating from a main oil gallery of the combustion engine. The disadvantage of such a control lies in that the control is directly connected to the oil pressure prevailing in the combustion engine, the flow rate, an engine rotational speed, a lubricant temperature and a spring force applied to the actuating unit. The objective of so-called characteristic map controls is the decoupling of the mentioned direct influence quantities on the control in order to achieve a control characteristic map of the lubricant pump, which can react to each individual influence quantity so as to come closer to the requirements of the combustion engine and at least reduce further drive outputs and dissipations. To this end, proportional valves are mostly used which switch a control oil pressure from the main oil gallery or from an output of the lubricant pump to the actuating units on or off as required.

If instances of controlling occur in such a control circuit or a defect of the proportional valve occurs, this can lead to an undersupply of the combustion engine and thus a damage of the latter. For this reason, a type of emergency operation control at a higher pressure level is provided with the usual lubricant pumps in order to continue supplying the combustion engine with lubricant even in the event of a failure of the proportional valve. Such a so-called "second level valve" constituting a type of piston valve is loaded with lubricant pressure on both sides in normal operation and on one side preloaded with a spring in order to be able to hold the actuating unit in a preferred position so that the control pressure from the proportional valve can directly act on the actuating unit of the lubricant pump. In the event of a defect of the proportional valve the lubricant pump does not receive a cut-off pressure via the proportional valve and thus delivers the maximum possible rate of delivery into the main oil gallery of the combustion engine. The second level valve in this case is loaded with the rising lubricant pressure of the main oil gallery only on one side and simultaneously assumes a position in which the lubricant, i.e. the oil of the main oil gallery can flow into and out of the actuating unit as a function of the oil pressure, thus regulating the lubricant pump to a desired higher pressure level. Disadvantageous with such a lubricant supply system however is a high parts variety with concomitant high assembly, storage and logistic costs.

SUMMARY

The present invention deals with the problem of stating a characteristic-map-controlled lubricant pump system that operates reliably and can be realised cost-effectively at the same time.

According to the invention, this problem is solved through the subjects of the independent claims. Advantageous embodiments are the subject of the dependent claims.

The present invention is based on the general idea of omitting a previously usual second level valve with a characteristic-map-controlled lubricant pump system with a lubricant pump through a suitable design of a lubricant pump. In the characteristic-map-controlled lubricant pump system according to the invention, a proportional valve is connected upstream of the actual lubricant pump which is connected in a communicating manner to the combustion engine on the input side and/or to an output of the lubricant pump. Within the lubricant pump according to the invention, a spring preloaded actuating unit, for example a ring or a slide, is arranged, via which a delivery output of the lubricant pump, which is usually designed as rotary vane pump, can be regulated. The lubricant pump according to the invention in this case comprises a first pressure chamber acting on the actuating unit, which can be pressurized in a characteristic-map-controlled manner and thus adjusts the actuating unit against the spring and at least a second pressure chamber acting on the actuating unit in the same manner. The second pressure chamber in this case is dimensioned smaller than the first one, so that upon a failure of the proportional valve the lubricant pump is exclusively loaded with pressure via the at least one second pressure chamber and because of its smaller dimension, generates a higher lubricant pressure, i.e. a higher oil pressure so that the combustion engine upon failure of the proportional valve is supplied with lubricant at a higher pressure level. Here, a permanently applied lubricant pressure acts on the first pressure chamber, likewise on the at least one second pressure chamber, wherein the ratio of the two pressure chambers and the spring preloading the actuating unit is so designed that the permanently applied lubricant pressure and the lubricant pressure apportioned via the proportional valve covers the entire characteristic map. The at least one second pressure chamber subjected to permanent onflow is so dimensioned in this case that upon a failure of the proportional valve, i.e. the sole application of the permanent lubricant pressure on the at least one second pressure chamber, the lubricant pump because of the spring counterforce onto the actuating unit remaining the same, continues operation at a higher pressure level and supplies the combustion engine with lubricant, i.e. in particular with oil. It is of particular advantage here that through the omission of the "second level valve" that had to be separately designed in the past and the omission of all necessary processing in a valve region, clearly fewer components are present which in addition would have to be elaborately assembled. The lubricant pump system according to the invention thus has a lower parts variety and concomitant with this lower storage and logistic costs as well as lower assembly costs. Through the omission of the second level valve, interactions with the actuating unit are additionally excluded. Furthermore, the characteristic-map-controlled lubricant pump system according to the invention operates at a higher force equilibrium upon a failure of the proportional valve, which minimises the influence of inner forces from a pump rotor set. Obviously, the lubricant pump according to the invention can also be employed elsewhere, so that the lubricant pump system according to the invention relates to a characteristic map control of all lubricant pumps that can be variably controlled hydraulically for combustion engines with second level control. The factors such as lubricant pressure, flow rate, engine rotational speed, lubricant temperature and the spring force applied to the actuating unit in this case can be taken into account separately from one another.

Characteristic-map-controlled means that contrary to the two or multiple-step control the proportional valve is not "only" switched on or switched off and the additional pressure or control chamber thus loaded with control pressure. Here, the temperature, the rotational speed, the oil pressure, the load case etc. of the unit to be supplied, for example a combustion engine, is determined and compared with a predetermined characteristic map (control system). Following this, the proportional valve is activated (pulsed) in a frequency modulated manner and because of the respective position of the proportional valve, the actuating unit of the lubricant pump brought into a certain position which allows the lubricant pump to produce rate of delivery and delivery pressure according to the predetermined "characteristic map". In the case of conventional multi-stage activations, the control pressures are directly dependent on oil temperature (medium temperature), rotational speed and the predetermined geometries of the (pressure) chambers. Here, exclusively the pressure chambers are switched on in addition.

In the known characteristic map control, the control pressure to the actuating unit of the lubricant pump is interrupted in the event of a defect of the proportional valve. The lubricant pump thus goes into full delivery, the pump output pressure rises until the pump output pressure opens the second level valve and supplies the lubricant pump internally with control pressure. The dimensioning of the SLR valve is effected so that it opens or closes at a correspondingly higher pressure compared with the normal working pressure of the lubricant pump and regulates the lubricant pump at this pressure level, supplying the combustion engine accordingly. Disadvantageous in this case are the interactions of the different mass-force systems of second level valve and actuating unit, which can lead to interactions up to overshooting of the entire second level control and actuating unit. In contrast with this, the lubricant pump according to the invention is steadily supplied with control pressure corresponding to the SLR level. An advantage lies in that the lubricant pump can be activated with pump output pressure (internally controlled) or with the pressure from the main supply channel and any points of the supply circuit. The characteristic map control activates the proportional valve in a high-frequency manner and because of the respective position of the proportional valve, a further actuating range in addition to the already present SLR pressure range is provided with pressure and the actuating unit of the lubricant pump brought into a certain position which allows the lubricant pump to produce rate of delivery and delivery pressure according to the predetermined "characteristic map".

Further important features and advantages of the invention are obtained from the subclaims, from the drawings and from the corresponding Figure description by means of the drawings.

It is to be understood that the features mentioned above and still to be explained in the following cannot only be used in the respective combination stated but also in other combinations or by themselves without leaving the scope of the present invention.

BRIEF DESCRIPTION OF THE DRAWINGS

Preferred exemplary embodiments of the invention are shown in the drawings and are explained in more detail in the following description, wherein same reference characters refer to same or similar or functionally same components.

Here it shows, in each case schematically.

DETAILED DESCRIPTION

Figure 1:
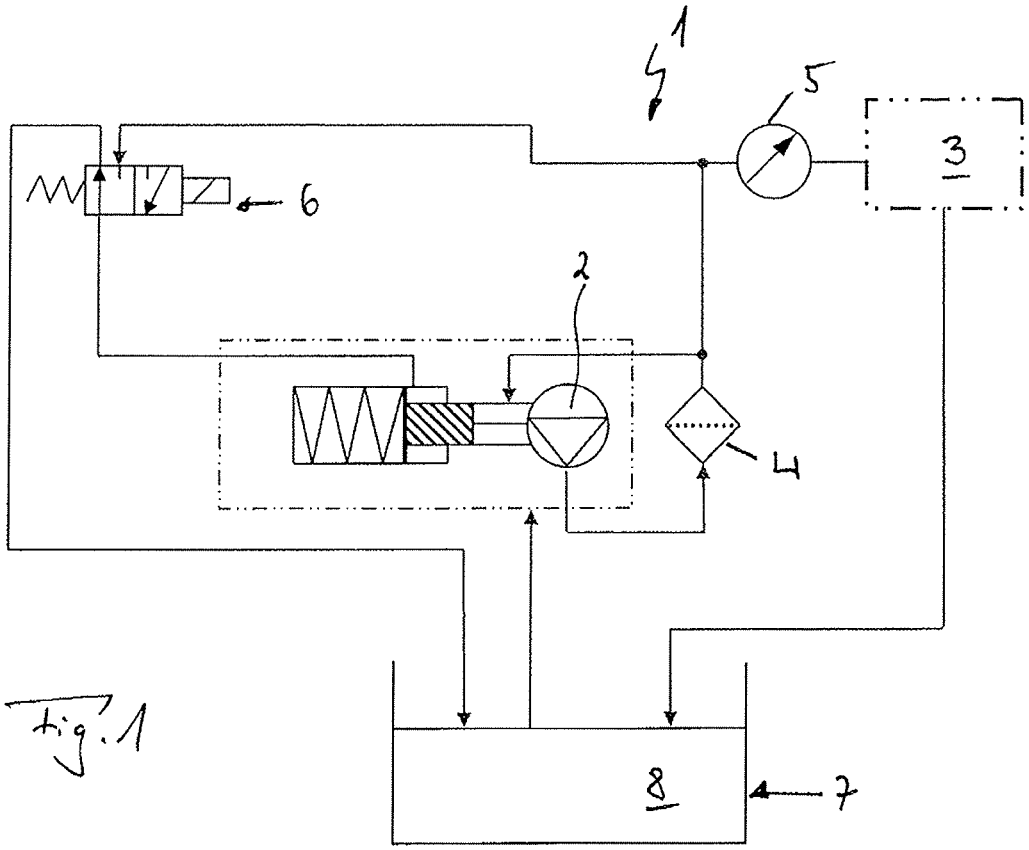
FIG. 1 a lubricant pump system according to the invention.

Corresponding to FIG. 1, a characteristic-map-controlled lubricant pump system 1 comprises a lubricant pump 2 which is designed for example as rotary vane pump and which serves for supplying a combustion engine 3 with lubricant. Within the lubricant pump system 1 according to the invention a filter 4 connected to an output side of the lubricant pump 2, a pressure sensor 5 and a proportional 6 are additionally arranged, wherein the latter can for example be designed as 3/2-way valve. Obviously, part of the lubricant pump system 1 according to the invention additionally is a lubricant reservoir 7, in which the lubricant, for example the oil 8, is collected. Independent of whether oil 8 is mentioned in the following, this is obviously to means also any other popular lubricant.

Here, the proportional valve 6, which is connected to the combustion engine 3 or an outlet of the lubricant pump 2 in a communicating manner serves for the control of the output of the lubricant pump 2. Looking especially at FIGS. 2 and 3 it is evident that within the lubricant pump 2 an adjustable actuating unit 9 is arranged, via which a rate of delivery of the lubricant pump 2 can be controlled and which is preloaded by a spring 10. Here, an oil pressure acts against a spring force of the spring 10 which oil pressure acts via a first pressure chamber 11 acting on the actuating unit 9 and via at least one second pressure chamber 12, 12'.

Figure 2:
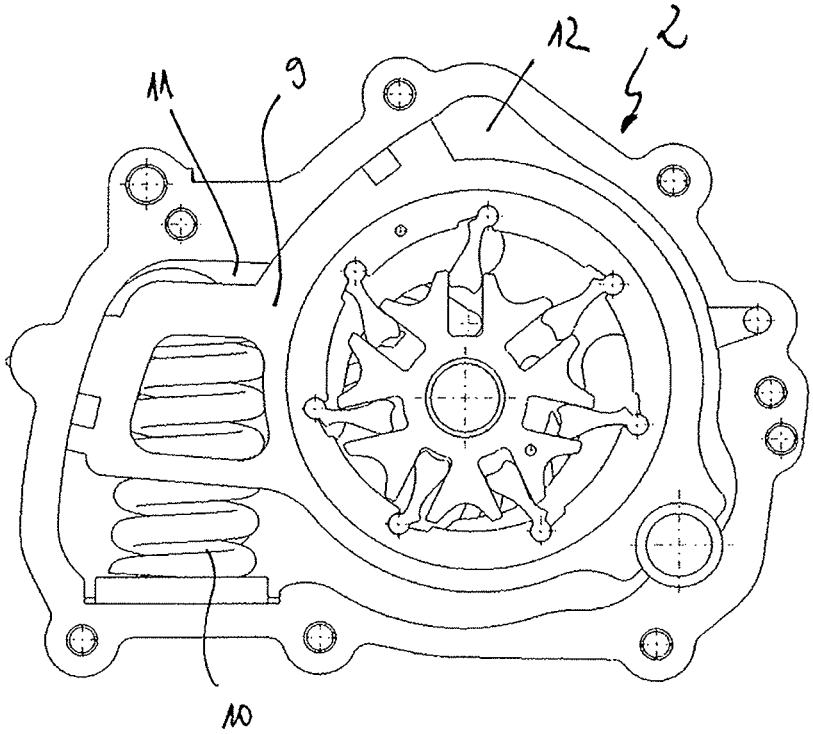
FIG. 2 a sectional representation through a possible embodiment of a lubricant pump, FIG. 3 a representation as in FIG. 2, however with another embodiment, FIG. 4 a further possible embodiment of the lubricant pump.
Figure 3:
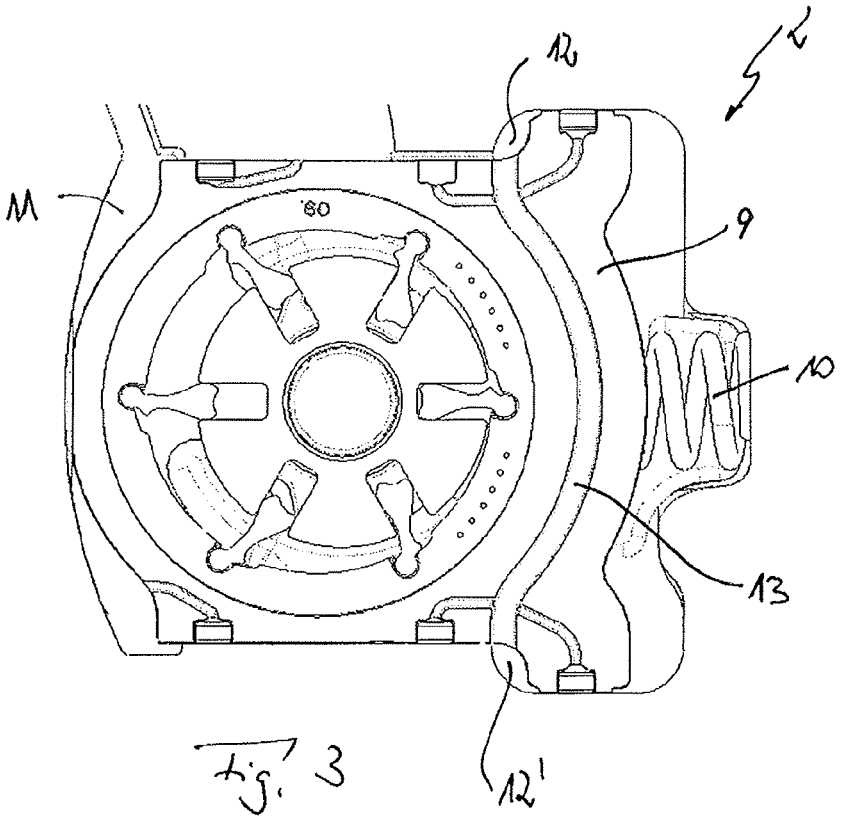

As is particularly evident from FIGS. 2 and 3, the at least one second pressure chamber 12, 12' in this case is dimensioned smaller than the first pressure chamber 11 and in the presence of two pressure chambers 12, 12', these are dimensioned smaller in sum than the first pressure chamber 11. Both the first pressure chamber 11 as well as the at least one second pressure chamber 12, 12' in this case is supplied with a characteristic-map-controlled oil pressure and depending on the introduced oil pressure, adjusts the actuating unit 9 against the spring force of the spring 10.

The first and/or the at least one second pressure chamber 11, 12, 12' in this case are connected in a communicating manner to the combustion engine 3 and/or to an output of the lubricant pump 2, wherein according to the lubricant pump 2 shown as per FIG. 3 two second pressure chambers 12, 12' are altogether provided, which are interconnected via a connecting channel 13.

Upon a failure of the proportional valve 6 the lubricant pump 2 is exclusively loaded with pressure via the at least one second pressure chamber 12, 12', wherein because of the smaller dimensioning of the at least one second pressure chamber 12, 12' a higher lubricant pressure is generated, so that the combustion engine 3 on the one hand is adequately supplied with lubricant even upon a failure of the proportional valve, but on the other hand this is carried out at a comparatively higher pressure level.

According to FIG. 2, the actuating unit 9 is configured in a pivotable manner, while according to FIG. 3 it is designed as translatorically adjustable slide. Because of the characteristic-map-controlled lubricant pump system 1 according to the invention, a previously required "second level valve" can be omitted, as a result of which fewer parts can be produced and assembled and thus the entire lubricant pump system 1 designed more cost effectively. In addition to this, interactions of the now omitted second level valve with the actuating unit 9 can be excluded, wherein the lubricant pump system 1 according to the invention in addition, in its second level control, in which exclusively the at least one second pressure chamber 12, 12' is loaded with pressure, operates at a higher force equilibrium, which minimises the influence of inner forces from a pump rotor set. With the lubricant pump 2 according to the invention, all factors such as for example oil pressure, flow rate, engine rotational speed, oil temperature as well as spring force can be considered separately from one another without additional second level valve. The proportional valve 6, which in the normal operating state serves for controlling the lubricant pump 2, in this case is connected on the input side to the combustion engine 3 via a main oil gallery and to the output of the lubricant pump 2.

Figure 4:
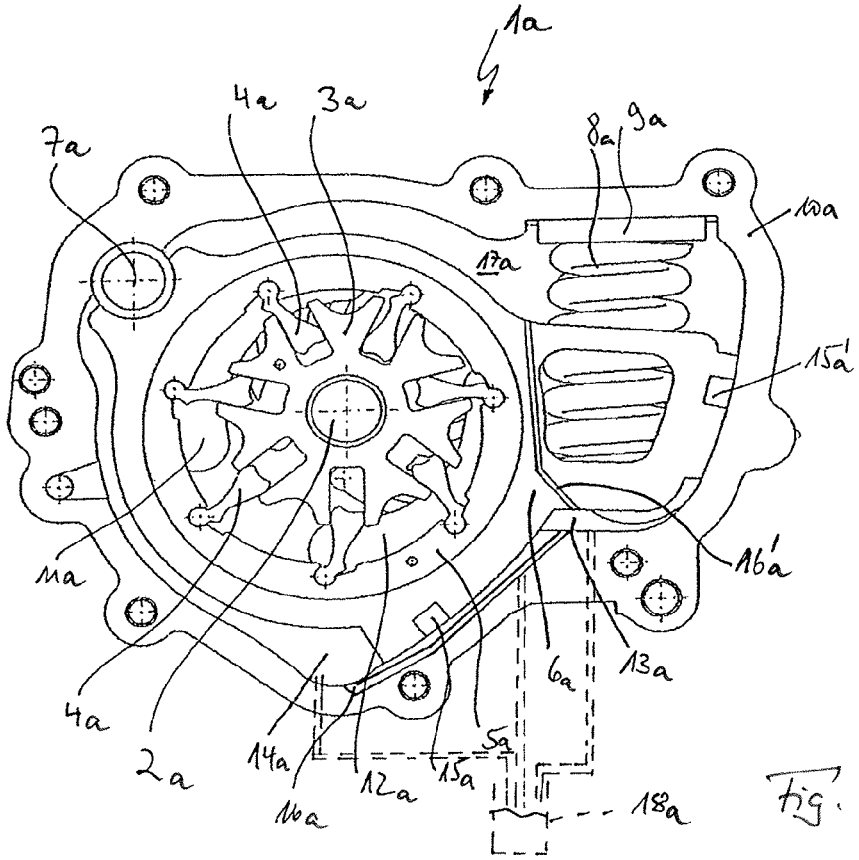

According to FIG. 4, a lubricant pump la comprises a shaft 2*a* on which a rotor 3*a* is arranged in a rotationally fixed manner. The rotor 3*a* in this case is operationally connected to a cage 5*a* via individual pendulums 4*a*, wherein the cage 5*a* is guided in a slide 6*a*. The slide 6*a* in turn is pivotably mounted about a bearing pin 7*a* and preloaded by means of a spring 8*a*. The spring 8*a*, for example a control spring, on one end supports itself on the slide 6*a* and on the other end on a spring backing 9*a* on the housing 10*a* of the lubricant pump 1*a*. By twisting the slide 6*a* about the bearing pin 7*a* a delivery output of the lubricant pump 1*a* according to the invention can be regulated in that for example the volumes of a pressure chamber 11*a* and a suction chamber 12*a* are changed through a change of the eccentricity of the rotor 3*a* to the slide 6*a*. Here, the lubricant pump 1*a* is designed as so-called rotary vane pump and usually serves for supplying a combustion engine that is not shown with lubricant, particularly with oil.

An adjusting of the slide 6*a* in this case is brought about by means of a hydraulic pressure within a control pressure chamber 14*a*, wherein a rise of the pressure in the control pressure chamber 14*a* brings about an adjusting of the slide 6*a* against the spring 8*a*. In addition to this, the slide 6*a* additionally separates a damping chamber 13*a* from a suction chamber 17*a*, wherein a separation between the control pressure chamber 14*a*, the damping chamber 13*a* and the suction chamber 17*a* is effected via sealing strips 15*a* and 15*a*' arranged on the slide 6, which seal the slide 6*a* against the housing 10*a* of the lubricant pump 1*a*.

According to the invention, a connection 16*a*, for example a connecting channel, for equalising pressure fluctuations and thus damping the lubricant pump 1*a* is provided between the control pressure chamber 14*a* and the damping chamber 13*a*. The connection 16*a* in this case cannot only be configured as connecting channel formed in the housing 10*a*, but can be likewise integrated as channel in the manner of a ground recess or even in the cast housing, between the slide 6*a* and the housing 10*a*. The connection 16*a* in this case is shown greatly enlarged according to FIG. 1 so that it can be normally designed so small that it develops a throttling effect. As an alternative to the connection 16*a*, a connection 16*a*' can also be provided between the damping chamber 13*a* and the suction chamber 17*a*, wherein this connection 16*a*' according to the invention runs within the slide 6*a* and in this case can likewise be designed as connecting channel. Obviously, in this case, a connection can also be formed between the damping chamber 13*a* and the suction chamber 17*a* alternatively as ground recess between the slide 6*a* and the housing 10*a* subject to overcoming the sealing strip 15*a'*.

Both variants have in common that any pressure fluctuations or pressure pulsations that may occur can be better offset and thus compensated through the connection 16*a* and 16*a*', wherein a damping of the vibrations of the slide that occur in the lubricant pump 1*a* can be achieved. The control pressure chamber 14*a* in this case is usually dimensioned smaller than the damping chamber 13*a* and is simultaneously connected on the input side usually to a main oil gallery of the combustion engine.

A further alternative is to connect a damping volume (lubricant reservoir 18*a*) attached outside to the housing 10*a* to one of the volumes in the pump by means of a throttling bore, which acts as the connection 16*a*, 16*a'*.

Through the connection 16*a*, transfer pumping of the oil from one to the other volume is achieved in all embodiments, while throttling takes place simultaneously as a result of which the pressure pulsations are reduced.

The invention claimed is:

1. A lubricant pump system comprising:

a lubricant pump for supplying a combustion engine with lubricant, wherein the lubricant pump is controlled by a proportional valve, the proportional valve being in communication with at least one of the combustion engine at an input side and an output of the lubricant pump;

an actuating unit arranged in the lubricant pump and preloaded by a spring, the actuating unit configured to control a delivery output of the lubricant pump;

a first pressure chamber acting on the actuating unit and pressurized in a characteristic-map-controlled manner, the first pressure chamber configured to adjust the actuating unit against the spring, the spring connected upstream of the proportional valve;

at least one second pressure chamber acting on the actuating unit and pressurized, the second pressure chamber configured to adjust the actuating unit against the spring;

wherein the at least one second pressure chamber is smaller in volume than the first pressure chamber;

wherein in response to a failure of the proportional valve the lubricant pump is exclusively pressurized via the at least one second pressure chamber, the second pressure chamber generates a higher lubricant pressure than that of the first pressure chamber;

wherein the second pressure chamber includes at least two second pressure chambers interconnected in a communicating manner via a connecting channel, wherein the two second pressure chambers are smaller than the first pressure chamber.

2. The lubricant pump system according to claim 1, further comprising a pressure sensor disposed between the proportional valve and the combustion engine.

3. The lubricant pump system according to claim 1, further comprising a filter disposed on an output side of the lubricant pump.

4. The lubricant pump system according to claim 1, wherein the proportional valve on the input side is connected to the combustion engine via a main oil gallery.

5. The lubricant pump system according to claim 4, wherein the first pressure chamber is indirectly connected to the main oil gallery via the proportional valve and the at least one of the second pressure chambers is directly connected to the main oil gallery.

6. A lubricant pump system comprising: a lubricant pump for supplying a combustion engine with lubricant, wherein the lubricant pump is controlled by a proportional valve, the proportional valve being in communication with at least one of the combustion engine at an input side and an output of the lubricant pump, an actuating unit arranged in the lubricant pump and preloaded by a spring, the actuating unit configured to control a delivery output of the lubricant pump, a first pressure chamber acting on the actuating unit and pressurized in a characteristic-map-controlled manner, the first pressure chamber configured to adjust the actuating unit against the spring, the spring connected upstream of the proportional valve, at least one second pressure chamber acting on the actuating unit and pressurized, the second pressure chamber configured to adjust the actuating unit against the spring, wherein the at least one second pressure chamber is smaller in volume than the first pressure chamber, and wherein in response to a failure of the proportional valve the lubricant pump is exclusively pressurized via the at least one second pressure chamber, the second pressure chamber generates a higher lubricant pressure than that of the first pressure chamber;

wherein at least one of the first pressure chamber and the at least one second pressure chamber is connected in a communicating manner on at least one of the input side to the combustion engine and the output of the lubricant pump;

wherein the at least one second pressure chamber includes at least two second pressure chambers interconnected in a communicating manner via a connecting channel, wherein the two second pressure chambers are smaller than the first pressure chamber.

7. The lubricant pump system according to claim 6, further comprising a pressure sensor disposed between the proportional valve and the combustion engine.

8. The lubricant pump system according to claim 7, further comprising a filter disposed on an output side of the lubricant pump.

9. The lubricant pump system according to claim 8, wherein the proportional valve on the input side is connected to the combustion engine via a main oil gallery.

* * * * *